US010323607B2

(12) United States Patent
Bailey et al.

(10) Patent No.: US 10,323,607 B2
(45) Date of Patent: Jun. 18, 2019

(54) METHOD AND SYSTEMS FOR DRAINING FLUID FROM AN ENGINE

(71) Applicant: General Electric Company, Schenectady, NY (US)

(72) Inventors: Kevin Paul Bailey, Mercer, PA (US); Daniel Edward Loringer, Erie, PA (US); Kent Jeffries, Fairview, PA (US); Eric David Peters, Erie, PA (US); David Marshall Wright, Decatur, TX (US); Christopher Joseph Homison, Wattsburg, PA (US)

(73) Assignee: GE Global Sourcing LLC, Norwalk, CT (US)

( * ) Notice: Subject to any disclaimer, the term of this patent is extended or adjusted under 35 U.S.C. 154(b) by 119 days.

(21) Appl. No.: 15/210,453

(22) Filed: Jul. 14, 2016

(65) Prior Publication Data

US 2018/0017025 A1 Jan. 18, 2018

(51) Int. Cl.

*F02M 26/35* (2016.01)
*F02M 26/04* (2016.01)
*F02M 26/30* (2016.01)

(52) U.S. Cl.

CPC ..... *F02M 26/35* (2016.02); *F02M 26/04* (2016.02); *F02M 26/30* (2016.02)

(58) Field of Classification Search

CPC ..... F02M 26/35; F02M 26/30; F02M 26/04
See application file for complete search history.

(56) References Cited

U.S. PATENT DOCUMENTS 6,164,063 A * 12/2000 Mendler ..... F01N 3/2882 60/274
7,302,795 B2 * 12/2007 Vetrovec ..... F01N 5/02 60/274
8,104,456 B2 * 1/2012 Yacoub ..... F02M 26/35 123/25 A
9,316,183 B2 * 4/2016 Rollins ..... F02M 25/0836
9,695,728 B2 * 7/2017 Takada ..... F01N 3/208
2016/0123283 A1 * 5/2016 Newman ..... F02M 35/10222 123/572
2016/0138451 A1 * 5/2016 Takada ..... F01N 3/2066 60/278
2016/0160806 A1 * 6/2016 Xiao ..... F02D 13/0203 123/568.11
2016/0186701 A1 * 6/2016 Ariizumi ..... F02B 39/16 60/280
2016/0273496 A1 * 9/2016 Paschal ..... F02M 26/35
(Continued)

FOREIGN PATENT DOCUMENTS

CN 104879247 A 9/2015
DE 102013220679 A1 4/2015
WO 2009045154 A1 4/2009

*Primary Examiner* — Hung Q Nguyen
*Assistant Examiner* — Xiao En Mo
(74) *Attorney, Agent, or Firm* — McCoy Russell LLP

(57) ABSTRACT

Various methods and systems are provided for a drain system for an EGR system of an engine system. In one example, the drain system includes a connector fluidly coupled to each of an intake system, an exhaust system, and a fluid collector, where the connector is positioned vertically below an intake manifold of the intake system and an exhaust passage of the exhaust system and vertically above the fluid collector with respect to a surface on which an engine sits.

22 Claims, 7 Drawing Sheets

(56) References Cited

U.S. PATENT DOCUMENTS

| | | | | |
|---|---|---|---|---|
| 2016/0305374 | A1* | 10/2016 | Jayakar | F02M 26/35 |
| 2016/0326992 | A1* | 11/2016 | Keating | F02M 26/22 |
| 2017/0342949 | A1* | 11/2017 | Kikuchi | F02M 26/04 |

* cited by examiner

METHOD AND SYSTEMS FOR DRAINING FLUID FROM AN ENGINE

BACKGROUND

Technical Field

Embodiments of the subject matter disclosed herein relate to a turbocharged engine system including an exhaust gas recirculation system.

Discussion of Art

Engines may utilize recirculation of exhaust gas from an engine exhaust system to an engine intake system, a process referred to as exhaust gas recirculation (EGR). In some examples, a group of one or more cylinders may have an exhaust manifold that is coupled to an intake passage of the engine such that the group of cylinders is dedicated, at least under some conditions, to generating exhaust gas for EGR. Such cylinders may be referred to as "donor cylinders." In other systems, the exhaust gas may be pulled from a manifold. Some EGR systems may include an EGR cooler to reduce a temperature of the recirculated exhaust gas before it enters the intake passage. Further, in some examples, the EGR system may route exhaust gases to an intake manifold of the intake system.

Engines may also utilize a turbocharger to provide increased power. Turbochargers function by compressing intake air in a compressor driven by a turbine operated by exhaust gas flow. In one example, the EGR system may route exhaust gases from the exhaust system, upstream of the turbine, and to the intake system, downstream of the compressor.

During engine operation, fluid (such as water or leaked coolant) may accumulate within the intake system of the engine. With the addition of the EGR system, the intake system is closed from atmosphere and there may be nowhere for accumulated fluid to go other than into the engine cylinders. However, this fluid may result in mechanical damage of engine components during engine running. Further, there may be no way to determine if coolant is leaking from the EGR cooler and accumulating within the intake manifold.

BRIEF DESCRIPTION

In one embodiment, a system for an exhaust gas recirculation (EGR) system includes a connector fluidly coupled to each of an intake system, an exhaust system, and a fluid collector. The connector is positioned vertically below an intake manifold and an exhaust passage and vertically above the fluid collector with respect to a surface on which an engine sits.

BRIEF DESCRIPTION OF THE DRAWINGS

FIGS. 3-6 are shown to scale, though other relative dimensions may be used.

DETAILED DESCRIPTION

The following description relates to embodiments of a system for an exhaust gas recirculation (EGR) system including a connector (in one example, a nozzle or a venturi nozzle) fluidly coupled via a plurality of conduits to each of an intake system, an exhaust system, and a fluid collector (in one example, a sump). The connector may be positioned vertically below an intake manifold of the intake system and an exhaust passage of the exhaust system and vertically above the fluid collector with respect to a surface on which an engine sits.

Figure 1:
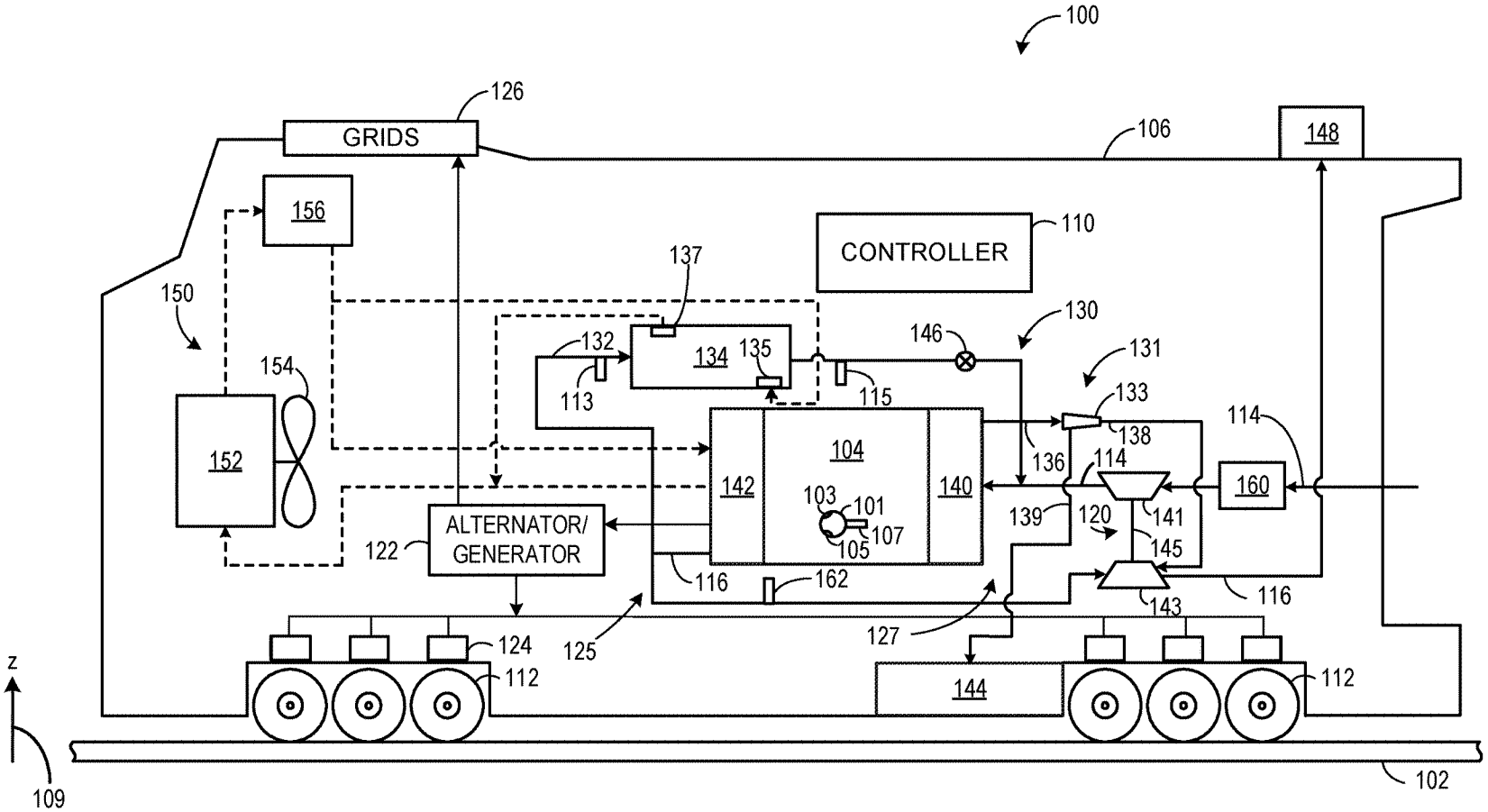
FIG. 1 shows a schematic diagram for an engine system including a drain system for an engine gas recirculation system according to an embodiment of the invention.
Figure 2:
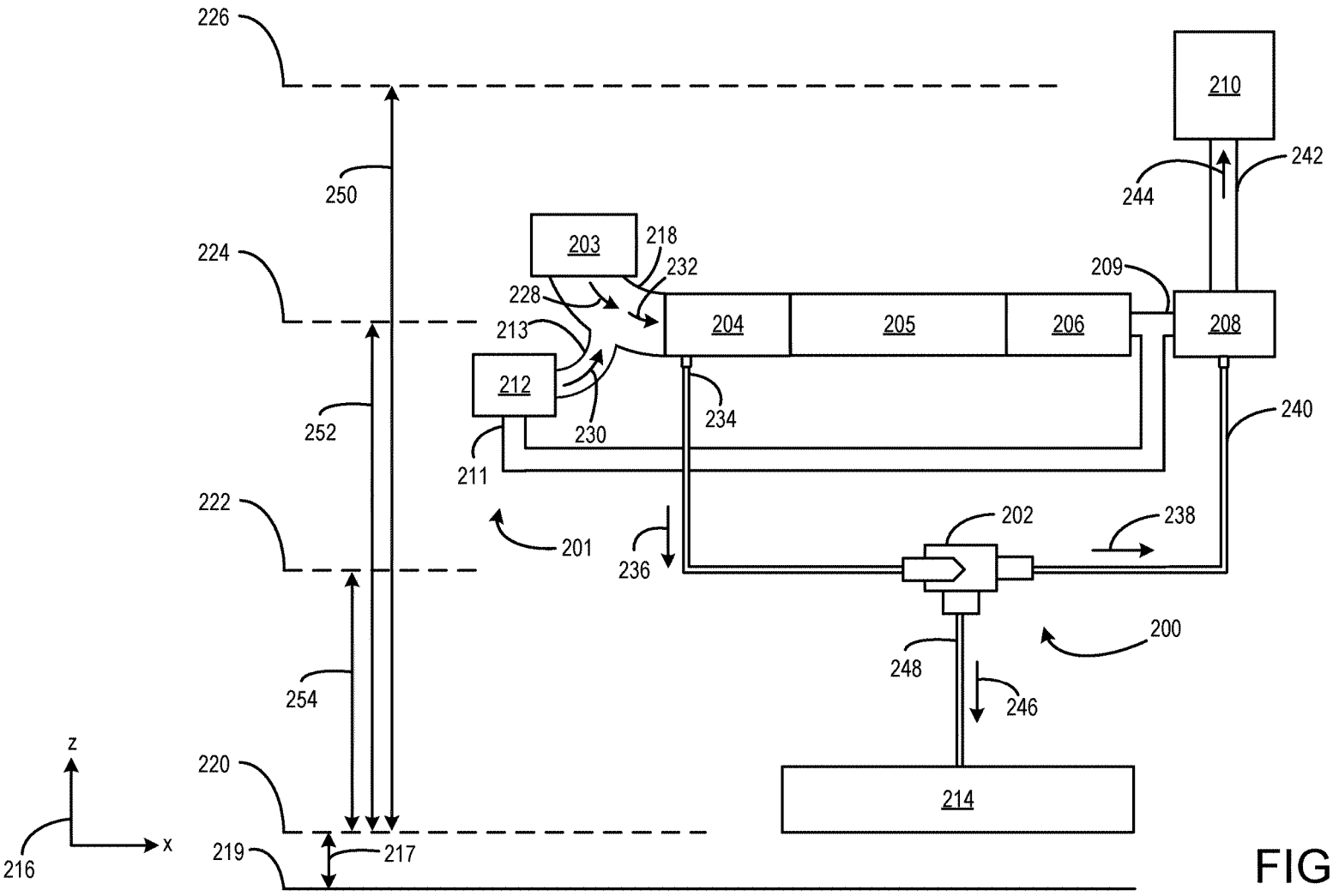
FIG. 2 shows a schematic diagram of a drain system for an exhaust gas recirculation (EGR) system including relative positioning of a connector according to an embodiment of the invention.
Figure 3:
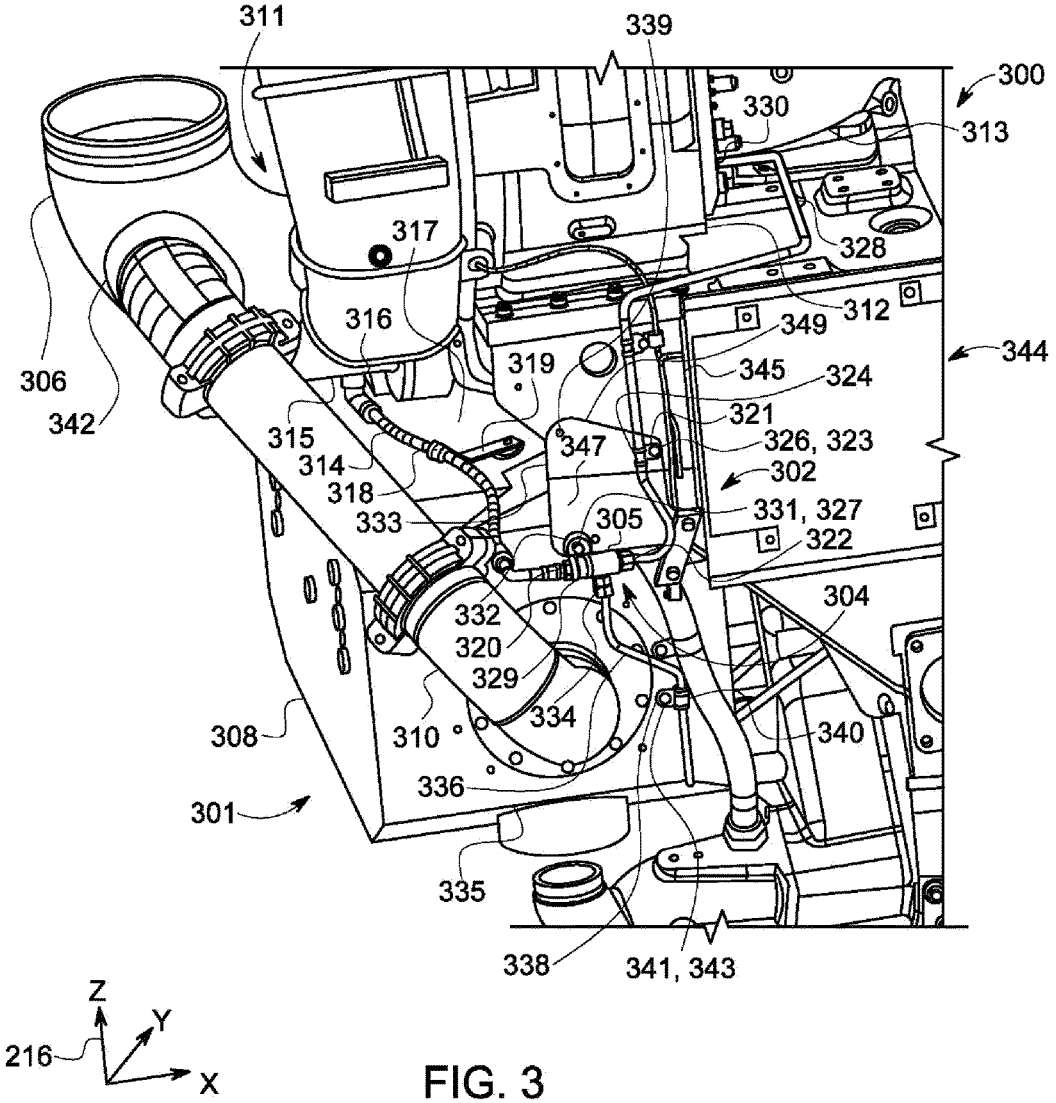
FIG. 3 shows a first perspective view of a drain system for an EGR system according to an embodiment of the invention.
Figure 5:
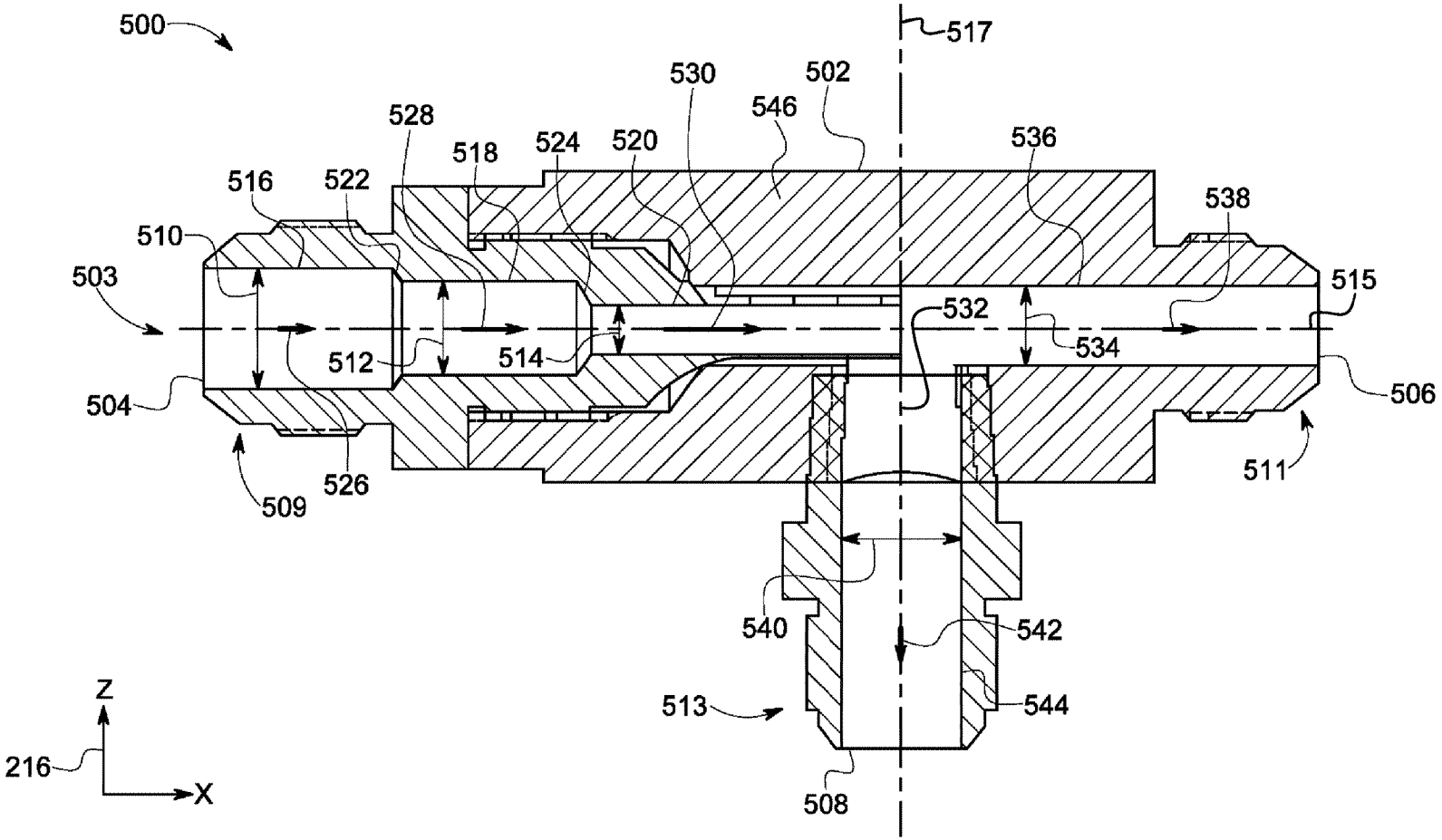
FIG. 5 shows a cross-sectional view of a connector included within a drain system for an EGR system according to an embodiment of the invention.
Figure 6:
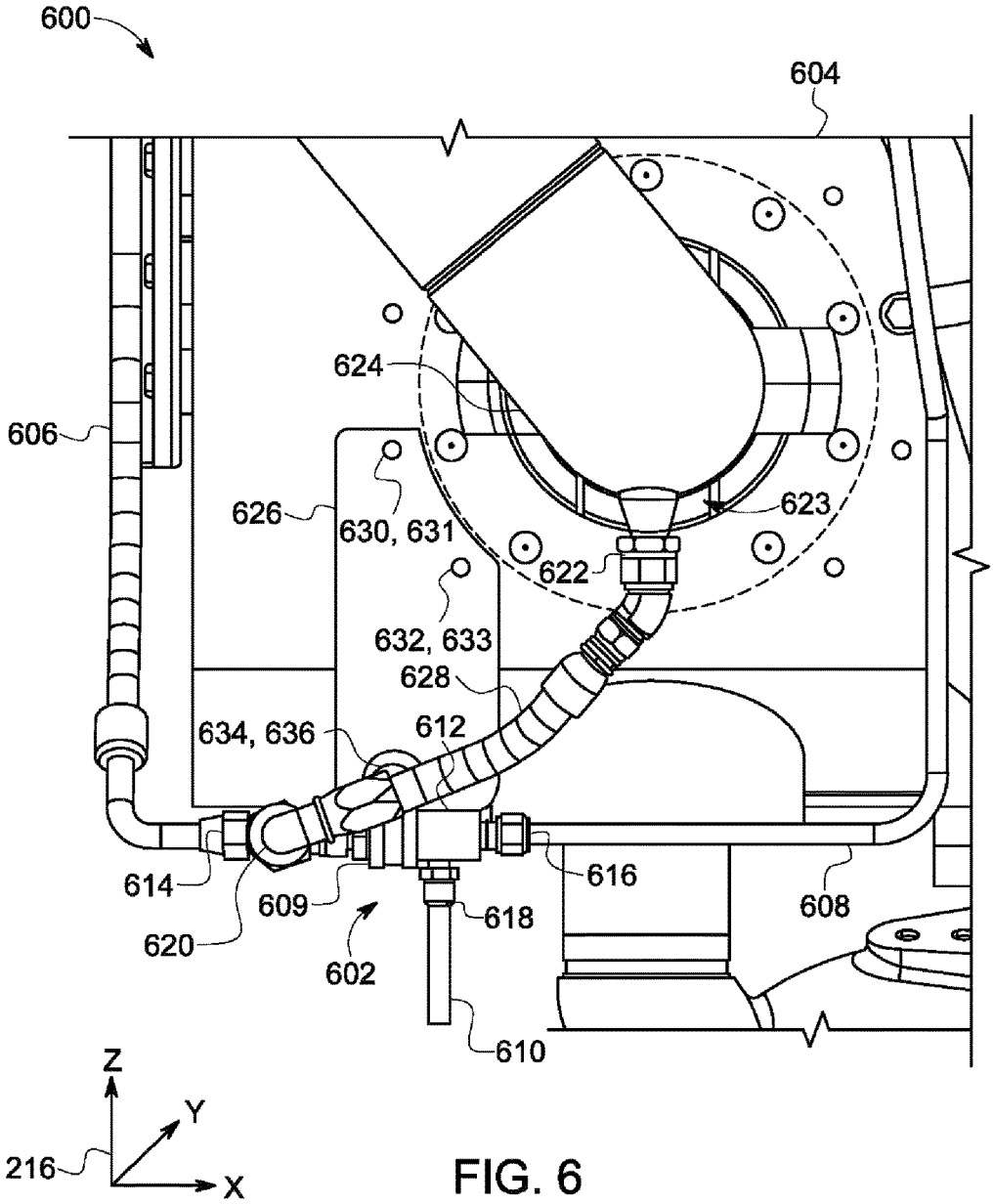
FIG. 6 shows a perspective view of an alternate embodiment of a drain system for an EGR system according to an embodiment of the invention.
Figure 7:
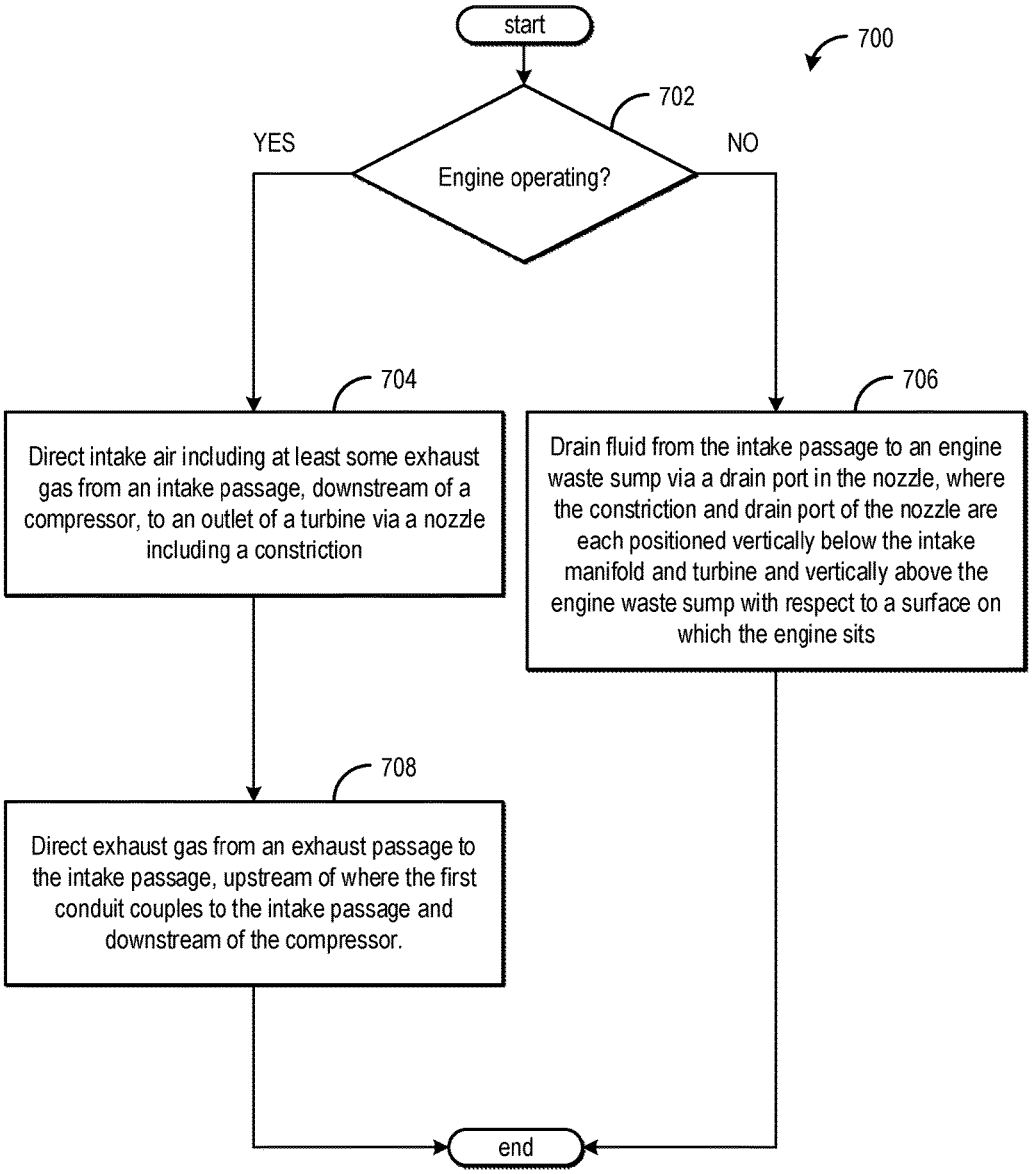
FIG. 7 shows a flow chart illustrating a method of flowing fluids through a connector included within a drain system for an EGR system based on operation or non-operation of an engine according to an embodiment of the invention.

An engine system, such as the engine system shown by FIG. 1, may include an EGR system. The engine system may further include an intake system including an intake manifold and an exhaust system including a turbine of a turbocharger and an exhaust passage. The EGR system may be coupled between the exhaust passage and the intake system, upstream of the intake manifold. Additionally, a connector may be coupled to each of the intake system, exhaust system, and a fluid collector (such as an engine sump) via a plurality of conduits. The connector and the plurality of conduits may be arranged, vertically (relative to a surface on which an engine of the engine system sits), below the intake manifold and exhaust passage (and exhaust manifold) and above the fluid collector, as shown by FIG. 2. In one example, the connector may be secured to the engine (such as a front end cover of the engine) by one or more support brackets, as shown by FIG. 3. A first conduit may couple an inlet port of the connector to a location in the intake system (e.g., at the intake manifold or a passage upstream of the intake manifold and downstream of where the EGR system couples to the intake system), a second conduit may couple an outlet port of the connector to a location in the exhaust system (e.g., at an outlet of the turbine), and a third conduit may couple the connector to the fluid collector. The conduits (such as the conduit shown by FIG. 4) are configured to flow gases from the intake system to the exhaust system during engine operation, and configured to flow liquid (such as accumulated fluid which may include condensate and/or leaked coolant from an EGR cooler of the EGR system) from the intake system and/or exhaust system to the fluid collector when the engine is not operating. In one example, the connector is a venturi nozzle configured to passively adjust a flow rate and flow direction of fluids through the connector, and the fluids flow through the connector via inlet, outlet, and drain ports of the connector, as shown by FIG. 5. In another embodiment, the connector is additionally coupled to a fourth conduit. The fourth conduit may be coupled to a drain port of an EGR passage of the EGR system, as shown by FIG. 6. An example flow of fluids through the connector (based on whether the engine is operating or is not operating) is shown by FIG. 7. In this way, water, condensate, and/or leaked coolant (from one or more heat exchangers of the engine such as the EGR cooler) that accumulate during engine operation may be drained from the intake manifold and/or exhaust passage when the engine turns off, via the connector, and to the fluid collector. As a result, during subsequent engine operation, the accumulated fluid may not be blown into the engine, thereby reducing a likelihood of engine damage. Further, since gas from the intake system may flow through the connector and to the exhaust passage during engine operation and due to the connector being positioned vertically below the exhaust passage, fluid may not escape the engine through the exhaust system during engine operation.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the approach for a system (e.g., drain system) including a connector fluidly coupled to each of an intake system, exhaust system, and fluid collector of an engine including an EGR system, an embodiment of the engine system is presented. Specifically, FIG. 1 shows a schematic diagram of an embodiment of an engine system 100, herein depicted as a rail vehicle 106 (e.g., locomotive), configured to run on a rail 102 via a plurality of wheels 112. As depicted, the rail vehicle includes an engine 104. The engine includes a plurality of cylinders, such as cylinder 101. While FIG. 1 shows one cylinder, the engine system may include additional cylinders that are not shown. Each of the cylinders includes at least one intake valve (such as intake valve 103), exhaust valve (such as exhaust valve 105), and fuel injector (such as fuel injector 107). Each intake valve, exhaust valve, and fuel injector may include an actuator that is actuatable via a signal from a controller 110 of the engine. In other non-limiting embodiments, the engine may be a stationary engine, such as in a power-plant application, or an engine in a marine vessel or other off-highway vehicle propulsion system as noted above. Further, in some embodiments, the plurality of cylinders may include a first group of donor cylinders and a second group of non-donor cylinders, where the donor cylinders supply exhaust to an exhaust gas recirculation (EGR) passage routing exhaust back to the intake of the engine, as explained further below.

An intake manifold 140 of an intake system 127 of the engine receives intake air for combustion from an intake passage 114. The intake passage is fluidly and directly connected to the intake manifold, and the intake manifold is fluidly coupled to each of the cylinders. The intake passage receives ambient air from an air filter 160 that filters air from outside of the rail vehicle. The intake passage flows the filtered air into the intake manifold where it is delivered to the cylinders. Exhaust gas resulting from combustion in the engine is supplied to an exhaust passage 116 directly and fluidly coupled to an exhaust manifold 142 of an exhaust system 125. Exhaust gas flows from the exhaust manifold, through the exhaust passage, and out of an exhaust stack 148 of the rail vehicle. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally combust fuel including gasoline, kerosene, natural gas, biodiesel, or other petroleum distillates of similar density through compression ignition (and/or spark ignition).

In one embodiment, the rail vehicle is a diesel-electric vehicle. As depicted in FIG. 1, the engine is coupled to an electric power generation system, which includes an alternator/generator 122 and electric traction motors 124. For example, the engine is a diesel and/or natural gas engine that generates a torque output that is transmitted to the alternator/generator which is mechanically coupled to the engine. In one embodiment herein, the engine is a multi-fuel engine operating with diesel fuel and natural gas, but in other examples the engine may use various combinations of fuels other than diesel and natural gas.

The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel set. As depicted herein, six traction motors correspond to each of six pairs of motive wheels of the rail vehicle. In another example, alternator/generator may be coupled to one or more resistive grids 126. The resistive grids may be configured to dissipate excess engine torque via heat produced by the grids from electricity generated by alternator/generator.

In some embodiments, the engine system may include a turbocharger 120 that is arranged between the intake passage and the exhaust passage. The turbocharger increases air charge of ambient air drawn into the intake passage in order to provide greater charge density during combustion to increase power output and/or engine-operating efficiency. The turbocharger may include a compressor 141 which is at least partially driven by a turbine 143 and coupled to the turbine via a shaft 145. While in this case a single turbocharger is included, the system may include multiple turbine and/or compressor stages. Additionally or alternatively, in some embodiments, a supercharger may be present to compress the intake air via a compressor driven by a motor or the engine, for example. Further, in some embodiments, a charge air cooler (not shown) such as a water-based intercooler may be arranged between the compressor of the turbocharger or supercharger and intake manifold of the engine, and may be fluidly coupled to both of the turbocharger or supercharger and the intake manifold. The charge air cooler may cool the compressed air to further increase the density of the charge air.

The engine system may further include an exhaust gas recirculation (EGR) system 130 coupled to the engine, which routes exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). As depicted in FIG. 1, the EGR system includes an EGR passage 132 and an EGR cooler 134 to reduce the temperature of the exhaust gas before it enters the intake passage. By introducing exhaust gas to the engine, the amount of available oxygen for combustion is decreased, thereby reducing the combustion flame temperatures and reducing the formation of nitrogen oxides (e.g., NOx). Additionally, the EGR system may include one or more sensors for measuring temperature and pressure of the exhaust gas flowing into and out of the EGR cooler. For example, there may be a temperature and/or pressure sensor 113 positioned upstream of the EGR cooler (e.g., at the exhaust inlet of the EGR cooler) and a temperature and/or pressure sensor 115 positioned downstream of the EGR cooler (e.g., at the exhaust outlet of the EGR cooler). In this way, the controller may measure a temperature and pressure at both the exhaust inlet and outlet of the EGR cooler.

In some embodiments, the EGR system may further include an EGR valve 146 for controlling an amount of exhaust gas that is recirculated from the exhaust passage of the engine to the intake passage of the engine. The EGR valve may be an on/off valve controlled by the controller, or it may control a variable amount of EGR. For example, the EGR valve may be opened to the exhaust passage and intake passage, closed to the exhaust passage and intake passage, or moved into a plurality of positions between fully opened or fully closed to the exhaust passage and intake passage. As shown in the non-limiting example embodiment of FIG. 1, the EGR system is a high-pressure EGR system (which routes exhaust gas from upstream of the turbine to downstream of the compressor). In other embodiments, the engine system may additionally include a low-pressure EGR system, routing EGR from downstream of the turbine to upstream of the compressor.

As depicted in FIG. 1, the engine system further includes a cooling system 150 (e.g., engine cooling system). The cooling system circulates coolant through the engine to absorb waste engine heat and distribute the heated coolant to a heat exchanger, such as a radiator 152 (e.g., radiator heat exchanger). In one example, the coolant may be water. A fan 154 may be coupled to the radiator in order to maintain an airflow through the radiator when the vehicle is moving slowly or stopped while the engine is running. In some examples, fan speed may be controlled by the controller. Coolant which is cooled by the radiator may enter a tank (not shown). The coolant may then be pumped by a water, or coolant, pump 156 back to the engine or to another component of the engine system, such as the EGR cooler and/or charge air cooler.

As shown in FIG. 1, a coolant/water passage from the pump splits in order to pump coolant (e.g., water) to both the EGR cooler and engine in parallel. In one example, as shown in FIG. 1, the pump may pump coolant (or cooling water) into a coolant inlet 135 arranged at a bottom surface (e.g., a surface relatively closer to a surface on which the engine system, or vehicle, sits) of the EGR cooler. Coolant flows through a plurality of cooling tubes (not shown) internal to an interior of the EGR cooler. Coolant may then exit the EGR cooler via a coolant exit 137 arranged at a top surface of the EGR cooler (e.g., a surface opposite and approximately parallel to the bottom surface of the EGR cooler). Thus, the EGR cooler may be filled with water (or coolant) from the bottom surface of the EGR cooler to the top surface via driving force from the pump. In some embodiments, the pump may then be arranged at a bottom surface of the EGR cooler. In this way, the EGR cooler may be filled with water or coolant through the bottom surface, thereby pushing air through and out the top surface of the EGR cooler. Thus, coolant may fill and flow through the cooling tubes in a direction opposite that of gravity (e.g., in a direction from the bottom surface to the top surface). Further, there may be one or more additional sensors coupled to the coolant inlet and coolant exit of the EGR cooler for measuring a temperature of the coolant entering and exiting the EGR cooler.

The rail vehicle further includes the controller (e.g., engine controller) to control various components related to the rail vehicle. As an example, various components of the engine system may be coupled to the controller via a communication channel or data bus. In one example, the controller includes a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the locomotive (such as tractive motor load, blower speed, etc.). The first controller may be configured to control various actuators based on output received from the second controller and/or the second controller may be configured to control various actuators based on output received from the first controller.

The controller may receive information from a plurality of sensors and may send control signals to a plurality of actuators. The controller, while overseeing control and management of the engine and/or rail vehicle, may be configured to receive signals from a variety of engine sensors, as further elaborated herein, in order to determine operating parameters and operating conditions, and correspondingly adjust various engine actuators to control operation of the engine and/or rail vehicle. For example, the engine controller may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, gas temperature in the EGR cooler, etc. The controller may also receive a signal of an amount of water in the exhaust from an exhaust oxygen sensor 162. Additional sensors, such as coolant temperature sensors, may be positioned in the cooling system. Correspondingly, the controller may control the engine and/or the rail vehicle by sending commands to various components such as the traction motors, the alternator/generator, fuel injectors, valves, or the like. For example, the controller may control the operation of a restrictive element (e.g., such as a valve) in the engine cooling system. Other actuators may be coupled to various locations in the rail vehicle.

The embodiment shown by FIG. 1 includes a drain system 131, wherein the drain system includes a connector (such as a nozzle) 133 fluidly coupled to each of the intake system, the exhaust system, and a fluid collector 144. In one example, the fluid collector may be a sump (e.g., a reservoir) configured to store one or more waste fluids of the engine system, and may include an opening arranged to receive fluids draining from the drain system. In another example, the fluid collector may be a partially open volume comprised of one or more surfaces of components of the engine system (e.g., such as surfaces of an underbody of the rail vehicle) arranged vertically (e.g., relative to a surface on which the engine sits and in a direction along vertical axis 109) below the engine.

The connector is fluidly coupled to the intake system via a first conduit 136. The first conduit is directly coupled to the connector and may be directly coupled to the intake manifold of the intake system, or directly coupled to the intake passage arranged upstream of the intake manifold. The first conduit is configured to flow gases from either the intake manifold or the intake passage through the first conduit and into the connector during operation of the engine system (e.g., during a condition in which the engine is on and operating).

The connector is additionally fluidly coupled to the exhaust system via a second conduit 138. The second conduit is directly coupled to the connector and may be directly coupled to an outlet (not shown by FIG. 1) of the turbine, or directly coupled to the exhaust passage downstream of the turbine. The second conduit is configured to flow air from the connector through the second conduit and into either the outlet of the turbine or the exhaust passage during operation of the engine system (e.g., during a condition in which the engine is operating).

The connector is also fluidly coupled to the fluid collector via a third conduit 139. The third conduit is directly coupled to the connector at a position vertically below the first conduit and the second conduit (e.g., along a bottom of the connector). The third conduit is directly coupled to the connector and may flow fluid from the connector, through the third conduit, and into the fluid collector when the engine is off and not operating.

Each of the first conduit, the second conduit, and the third conduit are fluidly coupled to each other via passages internal to the connector (as described in further detail below in an example embodiment of the connector shown by FIG. 5). In one embodiment, the first conduit may be configured to flow gases through the connector and into the second conduit during engine operation, but configured to not flow gases through the connector and into the third conduit during engine operation. Additionally, the second conduit may be configured to not flow gases through the connector into either of the first conduit or the third conduit during engine operation. The third conduit may be configured to flow fluid through the connector (from the intake passage or exhaust passage via the first conduit and second conduit, respectively) into the fluid collector when the engine is not operating (e.g., off) but configured to not flow fluid into the fluid collector during engine operation.

In an example of flows through the connector during engine operation, a first gas flow (e.g., intake air and/or EGR gases) from either the intake manifold or the intake passage may flow into the first conduit and through the connector. The first gas flow may flow through the connector into the second conduit, but the first gas flow does not flow through the connector into the third conduit. Gases may not flow from the second conduit into either of the first conduit or the third conduit.

In this way, intake air and/or EGR gases may flow from the intake system (via the first conduit), through the connector, and to the exhaust system (via the second conduit). However, intake air and/or EGR gases do not flow through the connector and into the atmosphere (e.g., through the third conduit) during engine operation. During a condition in which the engine is not operating (e.g., fuel is not being delivered to the engine and fuel combustion is not occurring), the connector is configured to flow fluid from the first conduit, through the connector, and into the third conduit. The connector may also be configured to flow fluid from the second conduit, through the connector, and into the third conduit. Flowing fluid through the first conduit may include flowing liquid (e.g., water, coolant, etc.) and/or gases from either the intake manifold or the intake passage. For example, liquid may accumulate in the intake manifold and/or the intake passage via condensation, coolant leaks, environmental conditions (e.g., rainfall), etc. Liquid that has accumulated within either the intake manifold or the intake passage may be injected into the cylinders during engine operation, resulting in engine degradation and/or decreased engine performance.

In an example of flows through the connector while the engine is not in operation, minimal gases may flow through any of the first conduit, the second conduit, and the third conduit (in some examples, little to no gas flow may occur through the connector). For example, because the engine is not in operation, a first gas pressure within the intake system may be approximately a same magnitude as a second gas pressure within the exhaust system, and both the first and second gas pressures may be approximately a same magnitude as atmospheric pressure. As a result, few gases may flow from either the first conduit, through the connector, and into the second conduit, or from the second conduit, through the connector, and into the first conduit. In other words, a lower pressure differential between the intake system and the exhaust system when the engine is not in operation decreases the flow of gases from the intake system to the exhaust system. Due to the spatial arrangement of the first, second, and third conduits relative to each other, liquids do not flow through the connector in the same way as the gases described above. As mentioned earlier above, the third conduit is directly coupled to the connector at a position vertically below the first conduit and the second conduit. As a result, liquid that has accumulated within the intake system may be forced by gravity to flow through the first conduit and into the connector. Similarly, liquid that has accumulated within the exhaust system (e.g., due to condensation) may be forced by gravity to flow through the second conduit and into the connector. Liquids flowing from either the first conduit or the second conduit into the connector may then be forced by gravity to flow into the third conduit due to the lower vertical position of the third conduit relative to the first and second conduits. In this way, accumulated liquids in the intake system and/or exhaust system may flow through the third conduit directly coupled to the connector and may be drained into the fluid collector. By removing accumulated liquid from the intake system and/or exhaust system via the connector, a risk of engine degradation may be reduced. Further examples of relative positioning of the connector, the first, second, and third conduits, and other engine components are described below with reference to FIGS. 2-4 and FIG. 6.

FIG. 2 shows a schematic diagram of a drain system for an engine system including an EGR system. Specifically, FIG. 2 depicts a vertical arrangement of a connector 202, a first conduit 234, a second conduit 240, and a third conduit 248 included within a system (e.g., drain system) 200 for an engine system including an EGR system 201 relative to other components included within the system. The first conduit is fluidly and directly coupled to both the connector and an intake manifold 204. While FIG. 2 depicts the first conduit coupled to the intake manifold, alternate embodiments may include the first conduit instead coupled to a location upstream of the intake manifold, such as intake passage 218 (which may herein be referred to as an EGR mixer pipe). The second conduit is fluidly and directly coupled to both the connector and an outlet of a turbine 208 of a turbocharger. In alternate embodiments, the second conduit may instead be fluidly and directly coupled to both of the connector and an exhaust passage upstream or downstream of the turbine. The third conduit is fluidly and directly coupled to both the connector and a fluid collector 214 (e.g., a sump or fluid reservoir, as described in the discussion of FIG. 1 above).

As described above in reference to FIG. 1, the EGR system may include a plurality of passages and other components configured to direct a controlled portion of exhaust gases from an exhaust manifold 206 (or downstream of the exhaust manifold, but upstream of the turbine 208) into the intake manifold (or upstream of the intake manifold but downstream of a compressor 203). For example, FIG. 2 shows an EGR cooler 212 configured to receive exhaust gases at a first temperature via a first EGR passage 211 coupled to an exhaust passage 209 upstream of the turbine. The EGR cooler cools the exhaust gases and outputs the exhaust gases at a second temperature via the second EGR passage 213 to the intake passage, with the second temperature being lower than the first temperature.

The intake passage included within the EGR system is fluidly and directly coupled to both the intake manifold and the second EGR passage. During an example operation of an engine 205, intake air may flow from the compressor 203 through the intake passage 218 in a direction indicated by intake flow 228, which includes compressed intake air. Additionally, exhaust gases cooled by the EGR cooler may flow through the second EGR passage 213 into the intake passage 218 in a direction indicated by EGR flow 230. Within the intake passage, intake flow and EGR flow may mix and combine to flow into the intake manifold as mixed gas flow 232.

While the engine is operating, a portion of the mixed gas flow may flow into the first conduit as a first conduit flow 236. The first conduit flow may flow through the connector and into the second conduit as second conduit flow 238. However, as described above with reference to FIG. 1, the first conduit flow does not flow into the third conduit while the engine is operating. The second conduit flow may flow into the outlet of the turbine of the turbocharger, and the outlet of the turbine may direct the second conduit flow into outlet passage 242 as outlet flow 244. The outlet flow may flow into the exhaust stack 210 where the outlet flow is dispersed into the atmosphere.

When the engine is not in operation, fluid (e.g., liquid water, coolant, etc.) that may accumulate within the intake manifold (or a location within an intake passage upstream of the intake manifold) may be forced by gravity to flow into the first conduit toward the connector, and fluid that may accumulate in the exhaust system (e.g., at the outlet of the turbine) may be forced by gravity to flow into the second conduit toward the connector. In alternate embodiments (such as the embodiment shown by FIG. 6 and described in the discussion of FIG. 6 below), the connector may be additionally fluidly and directly coupled to the second EGR passage via a fourth conduit (not shown by FIG. 2), and during conditions in which the engine is not in operation, fluid that may accumulate within the second EGR passage may flow into the fourth conduit toward the connector. Fluid flowing into the connector from any of the first, second, or fourth conduits may be forced by gravity to flow into the third conduit. Fluid flowing through the third conduit as third conduit flow 246 is forced by gravity into the fluid collector.

Axes 216 are shown by FIGS. 2-6 to illustrate the relative vertical arrangement of components of the system (such as the components described above) enabling the flows of fluids through the conduits via gravity when the engine is not in operation. The z-axis is a vertical axis and is used to indicate a vertical distance between the connector, first conduit, second conduit, third conduit, and other components shown by FIG. 2 (e.g., the intake manifold, exhaust manifold, turbine, etc.). For example, the fluid collector is arranged approximately at a first vertical position 220 along the z-axis. In one example, the first vertical position 220 may be a position of a bottom of a vehicle (e.g., a vehicle which includes the EGR system shown by FIG. 2) relative to a surface on which the vehicle sits, such as ground surface 219. In this example, the first vertical position 220 is a distance 217 above the ground surface 219. The connector is arranged approximately at a second vertical position 222 along the z-axis, where the second vertical position is displaced (e.g., spaced) a first distance 254 above the first vertical position. By arranging the connector at the second vertical position 222, the connector is arranged vertically above the fluid collector and the third conduit. The third conduit is coupled to a bottom portion of the connector (e.g., a portion of the connector oriented towards the first vertical position) and extends below the connector to couple to the fluid collector. The intake manifold, engine, exhaust manifold, intake passage, compressor, and turbine are arranged approximately at a third vertical position 224 along the z-axis, where the third vertical position is displaced a second distance 252 above the first vertical position, and with the second distance being greater than the first distance. By arranging the intake manifold, engine, exhaust manifold, intake passage, compressor, and turbine at approximately the third vertical position 224, the intake manifold, engine, exhaust manifold, intake passage, and turbocharger are arranged vertically above the connector, the first conduit, the second conduit, the third conduit, and the fluid collector. In alternate embodiments, the intake manifold, engine, exhaust manifold, intake passage, compressor, and/or turbine may be positioned at different vertical positions relative to one another. However, in such embodiments each of these components are positioned vertically above the connector (e.g., at a higher vertical positon than the second vertical position) and vertically above the first, second, and third conduits. The EGR cooler may be arranged approximately between the second vertical position and the third vertical position. The first conduit extends from the connector at the second vertical position 222 and couples to the intake manifold approximately at the third vertical position 224. The second conduit extends from the connector at the second vertical position 222 and couples to the outlet of the turbine approximately at the third vertical position 224. By arranging the system in this way, the first conduit and the second conduit are arranged vertically above the connector and the fluid collector, and vertically below the intake manifold and the turbine. The exhaust stack is arranged approximately at a fourth vertical position 226 along the z-axis, where the fourth vertical position is displaced a third distance 250 above the first vertical position, and with the third distance being greater than the second distance.

The intake manifold, engine, exhaust manifold, intake passage, EGR cooler, compressor, and turbine (which may herein be referred to as engine system components) may have a different relative arrangement to each other than the arrangement shown by FIG. 2. As one example, the turbine and compressor may be arranged slightly below the third vertical position (but above the first conduit, second conduit, and connector), while the intake manifold, exhaust manifold, and engine may be arranged slightly above the third vertical position (and above the first conduit, second conduit, and connector). In other words, the arrangement of the engine components shown by FIG. 2 with respect to each other may vary between embodiments, but in each embodiment the first conduit extends below a location where the first conduit couples to the intake system, the second conduit extends below a location where the second conduit couples to the exhaust system, the connector is arranged below both of the first and second conduits, and the third conduit extends from the bottom of the connector to a location below the connector.

By arranging the components of the system with the relative vertical configuration described above, an entirety of the first conduit may be arranged below a bottom surface of at least one of the intake manifold or the intake passage, an entirety of the second conduit may be arranged below a bottom surface of the turbine outlet, and an entirety of the third conduit may be arranged below a bottom surface of the connector. In this way, when the engine is not operating, gravity may force accumulated fluids from the intake system (e.g., the intake manifold or the intake passage) and/or the exhaust system (e.g., at the turbine outlet, or an exhaust passage upstream or downstream of the turbine outlet) into the fluid collector via the connector coupled to the first, second, and third conduits.

Figure 4:
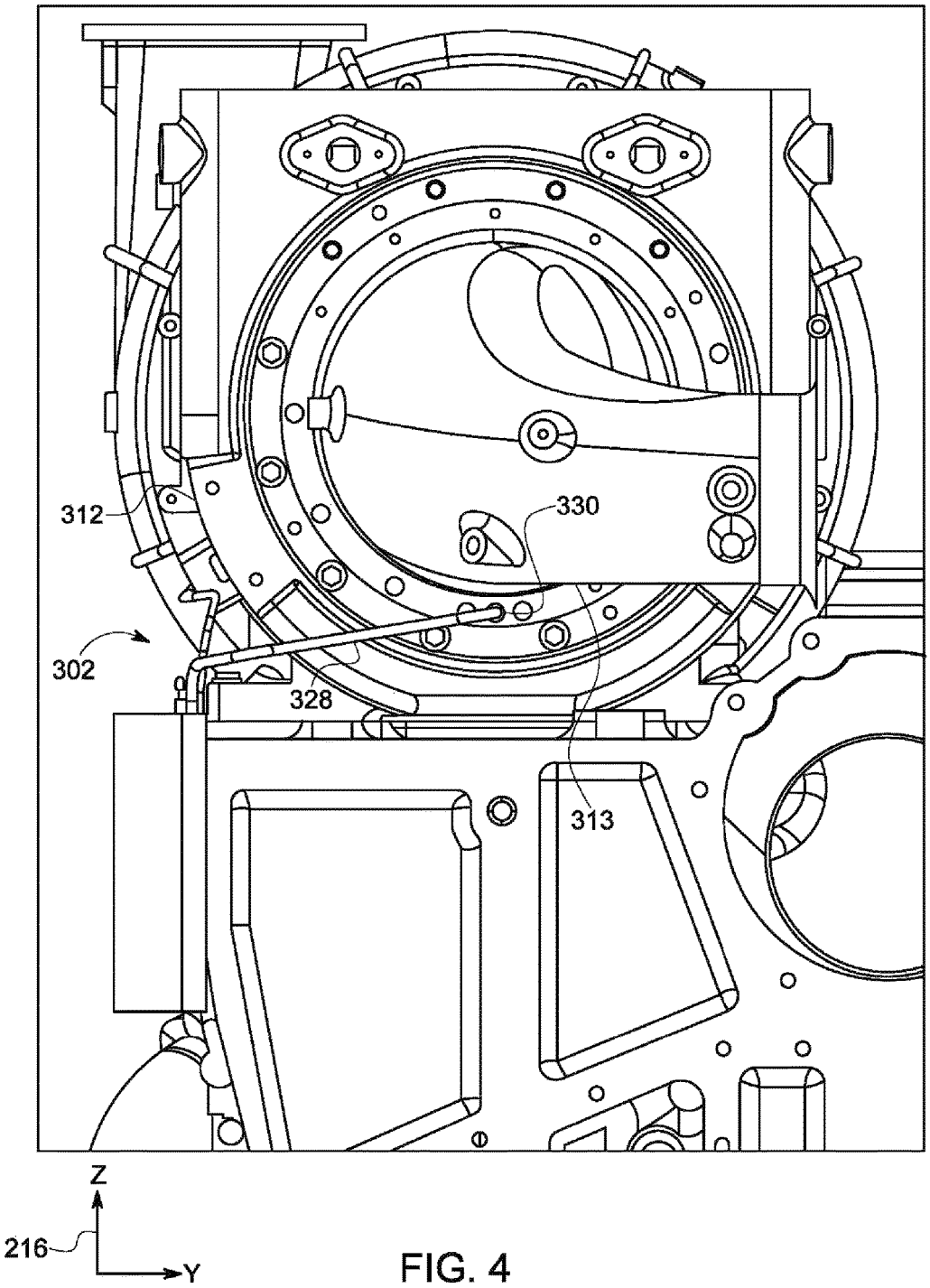
FIG. 4 shows a second perspective view of a drain system for an EGR system according to an embodiment of the invention.

FIGS. 3-4 show perspective views of a first embodiment of a drain system 302 of an engine system 300 including an EGR system 301 (such as drain system 131 shown in FIG. 1 and drain system 200 shown in FIG. 2). Components similar to several of the components shown schematically and described during the discussions of FIGS. 1-2 above are shown with relative position and scale by FIGS. 3-4.

Specifically, FIG. 3 shows the drain system including a connector (e.g., nozzle) 304, a first conduit 314, a second conduit 328, and a third conduit 336. The arrangement of the drain system (e.g., connector, first conduit, second conduit, and third conduit) within the engine and EGR system is similar to the arrangement shown by FIG. 2 and described above. However, the connector, first conduit, second conduit, and third conduit shown by FIG. 3 are secured in their arrangement via a plurality of clamps and mounting brackets coupled to either of an EGR cooler 308 or a front end cover 344 of the engine, as described in further detail below.

A support bracket 333 is directly coupled to the front end cover of the engine. The support bracket may be removeably mounted (e.g., bolted) or permanently mounted (e.g., welded or fused) to one or more surfaces of the front end cover (such as first cover surface 345). The support bracket includes a plurality of bracket eyelets (e.g., apertures) configured to align with a plurality of eyelets of the front end cover in order to mount the support bracket to the front end cover. For example, a fastener (e.g., threaded bolt, rivet, etc.) may be inserted through one or more of the bracket eyelets (such as third bracket eyelet 339) and the corresponding eyelets of the front end cover to secure (e.g., fixedly mount) the support bracket to the front end cover.

An outer housing 305 of the connector is shown directly mounted to the support bracket via a first clamp 329 coupled to the first bracket eyelet 331 of the support bracket. The first clamp surrounds a circumference of the outer housing of the connector and includes a first tab 332 (e.g., an extension) arranged approximately parallel to a first bracket surface 347. The first tab includes the first tab eyelet 327 configured to align with the first bracket eyelet. When a fastener (such as a bolt) is inserted through both of the first tab eyelet and the first bracket eyelet and secured to the support bracket (e.g., with a threaded nut), the first clamp retains the connector in a fixed position on the support bracket. In this way, by configuring the support bracket to mount to the front end cover of an engine, and by configuring the connector to mount to the support bracket via the first clamp, a fixed vertical position of the connector (relative to a surface on which the engine sits) may be selected. According to the embodiment shown by FIG. 3 (and described above with reference to the connector shown by FIG. 2), the vertical position of the connector may be below both of an intake manifold 311 and a turbine 312 of a turbocharger, and above a fluid collector.

The EGR system shown by FIG. 3 includes an EGR passage 310 fluidly and directly coupled to the EGR cooler. Cooled EGR gases flow from the EGR cooler through the EGR passage to an EGR inlet 342 of an intake passage 306. The first conduit is fluidly and directly coupled to a first drain port 316, with the first drain port arranged at a bottom surface 315 of the intake passage. In alternate embodiments, the first drain port may be arranged downstream of its location shown by FIG. 3 and within a bottom surface of an intake manifold.

An exterior of the first conduit is secured (e.g., coupled, but not fluidly coupled) to a first support arm 319 coupled to an outer, first surface 317 of the EGR cooler via a second clamp 318. The first support arm may be removably fixed (e.g., bolted) or permanently fixed (e.g., welded or fused) to the first surface of the EGR cooler. The second clamp encloses a circumference of the exterior of the first conduit and may apply a clamping force to the first support arm in order to secure the first conduit to the first support arm.

The first conduit is additionally fluidly and directly coupled to an inlet port 320 of the connector. In this configuration, fluid (e.g., gases when the engine is operating, and accumulated liquids when the engine is not operating, as described above with reference to FIGS. 1-2) may flow from the first drain port of the intake passage through the first conduit and into the inlet port of the connector.

The connector includes a connector drain port 334 fluidly and directly coupled to the third conduit. The third conduit is held in its entirety in a vertical position below the connector drain port by a third clamp 340 surrounding a circumference of the third conduit. The third clamp includes a third clamp tab 338 arranged approximately parallel to an outer, second EGR cooler surface 335. The third clamp tab includes a third tab eyelet 341 configured to align with an EGR cooler eyelet 343. When a fastener is inserted through the third tab eyelet and the EGR cooler eyelet, the third clamp may be secured (e.g., coupled) to the first EGR cooler surface. In this way, when the third clamp surrounds a circumference of the third conduit, securing the third clamp to the first EGR cooler surface also fixes a position of the third conduit below the drain port of the connector.

The connector also includes a connector outlet port 322 fluidly and directly coupled to the second conduit. The second conduit shown by FIG. 3 is additionally fluidly coupled to a turbine outlet 313 of turbine 312. This coupling is shown from a different perspective by FIG. 4. FIG. 4 depicts a second perspective view of the first embodiment of the drain system shown by FIG. 3, with the second perspective (shown by FIG. 4) approximately perpendicular to the first perspective (shown by FIG. 3) as indicated by the axes. As shown by FIG. 4, the second conduit is directly coupled to the turbine outlet at a flange 330 surrounding the turbine outlet. Further, as seen in FIG. 4, the second conduit (e.g., second end of the second conduit) is directly coupled to a bottom of the flange of the turbine outlet which may be positioned at a lowest point (relative to the vertical axis) of the turbine outlet. In alternate embodiments, the second conduit may be directly coupled to an exhaust passage upstream or downstream of the turbine outlet.

Returning now to FIG. 3, a fourth clamp 324 is shown directly coupled to the second conduit. The fourth clamp surrounds a circumference of the second conduit and includes a fourth clamp tab 321. The fourth clamp tab is arranged approximately parallel to a second bracket surface 349 and includes a fourth tab eyelet 326 configured to align with a second bracket eyelet 323. When a fastener is inserted through both of the fourth tab eyelet and the second bracket eyelet, the fourth clamp tab may be secured (e.g., coupled) to the second bracket surface. In this way, when the fourth clamp tab is secured to the second bracket surface and the fourth clamp surrounds a circumference of the second conduit, the second conduit may be fixed in its vertical position (e.g., with an entirety of the second conduit arranged above the connector outlet port).

Alternate embodiments of the system shown by FIGS. 3-4 may include a different number of clamps, clamp tabs, tab eyelets, and/or bracket eyelets. The clamps may also secure the conduits to alternate and/or additional surfaces of the EGR system. In each embodiment, the first conduit and second conduit may be secured (e.g., clamped) in a position vertically above the connector, while the third conduit may be secured in a position vertically below the connector.

FIG. 5 depicts a cross-sectional view of an example connector. The connector 500 may be included as any of the connectors shown in the drain systems of FIGS. 1-4 and 6. In the example shown by FIG. 5, the connector is a venturi nozzle configured to flow gases from an intake manifold and/or an intake passage upstream of the intake manifold through the connector and toward an outlet of a turbine of a turbocharger during engine operation. Additionally, the connector is configured to flow non-gaseous fluid (e.g., liquid water) from the intake manifold and/or the intake passage through the connector and into a fluid collector as described above with reference to FIGS. 1-4.

The connector includes an outer housing 502. The outer housing may be formed as one piece (e.g., cast or forged as a single unit) or it may be formed as a plurality of pieces coupled to each other (e.g., coupled via threaded fasteners, adhesives, etc.). A solid inner volume 546 of the connector is defined as a volume between the outer housing and a plurality of passages internal to an interior of the outer housing. In other words, the outer housing of the connector defines an exterior of the connector, the plurality of passages define a cavity within an interior of the connector, and the volume between the outer housing and the plurality of passages is solid (e.g., metal, plastic, etc.).

An inlet port 504 (which may be similar to inlet port 320 of FIG. 3 and configured to connect to an intake passage via a first conduit) is arranged at a first end 509 of the connector, and an outlet port 506 (which may be similar to connector outlet port 322 of FIG. 3 and configured to connect to an outlet of a turbine via a second conduit) is arranged at a second end 511 of the connector, with the second end opposite to the first end along a central axis 515 of the connector. A drain port 508 (which may be similar to connector drain port 334 of FIG. 3 and configured to connect to a fluid collector arranged vertically below the connector) is arranged at a third end 513 of the connector, with the third end arranged away from the central axis along a second axis 517, and with the second axis perpendicular to the central axis. Within a drain system (such as the systems shown by FIGS. 1-4 and FIG. 6), the third end (and the drain port) of the connector (e.g., the venturi nozzle) is arranged such that the third end extends in a direction approximately parallel to a direction of gravity. By arranging the connector in this way, the drain port is arranged at a vertical position below both of the inlet port and the outlet port relative to a surface on which an engine sits (e.g., an engine with a system for an EGR system which includes the connector).

Fluidly coupled to the inlet port and included within an interior of the connector is a first passage 503. The first passage may include a first portion 516, where the first portion may be an approximately cylindrical cavity included within the interior of the connector and may be arranged along (e.g., parallel to) the central axis of the connector, extending from the first end toward the second end. The first portion may have a first diameter 510. The first passage may also include a second portion 518, with the second portion having a second diameter 512, and with the second portion arranged parallel and fluidly coupled to the first portion by a first constriction 522 within the interior of the connector. In other words, the first constriction is arranged between the first portion and the second portion along the central axis of the connector. The first constriction fluidly couples the first portion to the second portion by tapering from the first diameter to the second diameter, with the second diameter decreased relative to the first diameter. The first passage may also include a third portion 520, with the third portion having a third diameter 514, and with the third portion arranged parallel and fluidly coupled to the second portion by a second constriction 524 (which may be a narrowest constriction of the nozzle) within the interior of the connector. In other words, the second constriction is arranged between the second portion and the third portion along the central axis of the connector. The second constriction fluidly couples the second portion to the third portion by tapering from the second diameter to the third diameter, with the third diameter decreased relative to the second diameter.

Fluidly coupled to the outlet port and included within an interior of the connector is a second passage 536. The second passage may be an approximately cylindrical cavity included within the interior of the connector and may be arranged along (e.g., parallel to) the central axis of the connector, extending from the second end towards the first end. The second passage may have a fourth diameter 534, where the fourth diameter is increased relative to the third diameter. The second passage may be fluidly coupled to the third portion of the first passage such that the inlet port of the connector is fluidly coupled to the outlet port of the connector.

Fluidly coupled to the drain port and included within an interior of the connector is a third passage 544. The third passage may be an approximately cylindrical cavity included within the interior of the connector and may be arranged along (e.g., parallel to) the second axis of the connector (perpendicular to the central axis), extending from the third end towards a junction 532 where the first passage couples to the second passage. In this way, the first passage, second passage, and third passage may be fluidly coupled to each other via the junction. The third passage may have a fifth diameter 540, where the fifth diameter is increased relative to the fourth diameter.

As described above with reference to FIGS. 1-4, when the engine is in operation, gas may flow into the connector (in this case, the venturi nozzle) through the inlet port and into the first portion of the first passage as indicated by first arrow 526. The gas may flow from the first portion into the second portion as indicated by second arrow 528, and a static pressure of the gas may decrease while a velocity of the gas may increase due to the first constriction reducing a flow diameter from the first diameter to the second diameter. The gas may then flow from the second portion into the third portion as indicated by third arrow 530, and a static pressure of the gas may again decrease while a velocity of the gas may again increase due to the second constriction further reducing the flow diameter from the second diameter to the third diameter.

As a result of the decrease in static pressure of the gas flow at the junction compared to the static pressure of the gas flow at the inlet port, the static pressure of the gas flow at the junction may have a magnitude such that the gas has an increased tendency to flow from the first passage into the second passage in a direction indicated by fourth arrow 538. For example, the outlet port may be fluidly coupled to an outlet of a turbine (e.g., by a conduit such as the second conduit shown by FIGS. 3-4) and a static pressure of gas at the turbine outlet may be lower than atmospheric pressure. Additionally, the drain port may be fluidly coupled to a fluid collector (e.g., by a conduit such as the third conduit shown by FIG. 3), and a static pressure of gas at the fluid collector may be approximately at atmospheric pressure.

As a result, gases flowing through either of the first passage or the second passage may have a reduced tendency to flow into the third passage while the engine is in operation. Additionally, the decreased static pressure of the gas at the junction may result in a vacuum in the third passage, which may prevent flow of gases into the third passage from the connector. In this way, the arrangement and diameters of the passages (including the constrictions) within the connector may decrease a likelihood of EGR gases to flow from an intake system, through the inlet port, and out the drain port into the atmosphere. However, when the engine is not in operation, liquid may be forced by gravity to flow into the inlet port and/or the outlet port from the intake system and/or the turbine outlet, respectively (as described above with reference to FIGS. 1-4). Liquid entering the inlet port and/or the outlet port may the flow through the third passage in a direction indicated by fifth arrow 542 and out of the drain port.

By configuring the connector to decrease EGR gas flow into the atmosphere during engine operation and to increase flow of accumulated liquid from the intake system and/or turbine outlet to the fluid collector while the engine is not operating, engine degradation and noxious emissions may be reduced.

FIG. 6 depicts a second embodiment of a drain system for an EGR system of an engine including a connector and a plurality of conduits coupled to the connector. Connector 612 included within drain system 602 for EGR system 600 is fluidly and directly coupled to each of first conduit 606 via first inlet port 614, second conduit 608 via outlet port 616, and third conduit 610 via drain port 618. The connector shown by FIG. 6 is additionally fluidly and directly coupled to a fourth conduit 628 via second inlet port 620.

Similar to the connector and conduits described above during the discussion of FIGS. 1-4, the connector shown by FIG. 6 is fluidly coupled to a location in an intake system (e.g., either at an intake manifold or at an intake passage upstream of the intake manifold) by the first conduit. The connector is fluidly coupled to an exhaust system (e.g., at an outlet of a turbine) by the second conduit, and the connector is fluidly coupled to a fluid collector via the third conduit.

The connector shown by FIG. 6 is arranged at a vertical position (relative to a surface on which an engine sits) beneath an EGR passage 624 of an EGR cooler 604. The EGR cooler flows cooled exhaust gas through the EGR passage and into an intake system. A bottom surface 623 of the EGR passage includes an EGR drain port 622 fluidly and directly coupled to the fourth conduit. The connector is held in its arrangement (e.g., fixed at its vertical position below the EGR cooler) via a support bracket 626. The support bracket includes a first bracket eyelet 630 configured to align with a first cooler eyelet 631 and a second bracket eyelet 632 configured to align with a second cooler eyelet 633. When the support bracket is oriented such that the bracket eyelets align with the cooler eyelets, the bracket may be retained in its position by insertion of fasteners (e.g., bolts, rivets, etc.) through the bracket eyelets to couple the support bracket to the EGR cooler. In alternate embodiments, the support bracket may include additional or fewer eyelets.

The support bracket also includes a third bracket eyelet 634 configured to align with a clamp eyelet 636 of a clamp 609. The clamp surrounds a circumference of the connector. When a fastener (e.g., a bolt) is inserted through the clamp eyelet and the third bracket eyelet in their aligned position, the clamp may be coupled to the bracket. By coupling the clamp to the bracket while the clamp surrounds the circumference of the connector, the connector is also coupled to the bracket. By configuring the third bracket eyelet to be arranged at a lower vertical position than the EGR passage when the first and second bracket eyelets are coupled to the EGR cooler, the connector may also be arranged in the lower vertical position.

With the connector in the lower vertical position, fluids may flow from the intake system and/or exhaust system as described above in the discussion of the connector and conduits shown by FIGS. 3-4. For example, during engine operation, EGR gas may flow through the first conduit and into the second conduit (but not into the third conduit) via the connector.

During engine operation, if one or more cooling tubes (not shown) internal to an interior of the EGR cooler have become degraded, coolant flowing through the cooling tubes may leak out of the cooling tubes and flow into one or more passages of the intake system (such as EGR passage 624). The leaked coolant flowing into EGR passage 624, for example, may accumulate and form a pool within EGR passage 624. Coolant flowing into the intake system may also accumulate and pool at one or more locations downstream of EGR passage 624 within the intake system. As another example, during engine operation, condensate may form and accumulate at a location within the exhaust system (e.g., at the outlet of the turbine).

When the engine is not operating, accumulated liquids (e.g., water, coolant, etc.) in the intake system and/or exhaust system may be forced by gravity to flow through the first and/or second conduits into the connector and through the third conduit towards the fluid collector. In other words, leaked coolant (e.g., from cooling tubes of the EGR cooler) and/or water may drain into the fluid collector when the engine is not operating (e.g., the engine is off and not combusting fuel and air). In this way, the embodiment of the connector shown by FIG. 6 functions in a similar way to the embodiment of the connector shown by FIGS. 3-4. In one embodiment, a user/operator of the engine may visually observe an amount of leaked coolant within the fluid collector (e.g., leaked coolant that has drained into the fluid collector via the third conduit) and may determine whether degradation of the EGR cooler has occurred based on the amount of leaked coolant within the fluid collector.

However, due to the coupling of the connector (in its position beneath the EGR passage) with the EGR drain port via the fourth conduit, EGR gas may flow into the connector via the fourth conduit during engine operation. Additionally, when the engine is not operating, liquids that may accumulate within the EGR passage may be forced by gravity to flow into the connector and through the third conduit into the fluid collector.

In one example, during engine operation, EGR gas may flow from the intake system (e.g., at a coupled location of the first conduit, from either the intake manifold or the intake passage upstream of the intake manifold) through the first conduit and into the connector. EGR gas may additionally flow from the EGR drain port through the fourth conduit and into the connector. The EGR gas from the first conduit and the fourth conduit may mix and converge within the connector and flow into the second conduit but not the third conduit.

In a second example, while the engine is not operating, liquid that may have accumulated within the intake system may flow into the connector via the first conduit, while fluid that may have accumulated within the exhaust system may flow into the connector via the second conduit. Additionally, liquid that may have accumulated within the EGR passage may flow out of the EGR drain port and into the connector via the fourth conduit. Liquid flowing into the connector via the first, second, and/or fourth conduits may mix and converge within the connector. The liquids may then flow out of the drain port of the connector and into the fluid collector via the third conduit.

FIG. 7 depicts a method for an engine that includes flowing gases (during engine operation) or flowing liquid fluids (such as water or coolant, while the engine is not operating) through a nozzle (such as the venturi nozzle shown by FIG. 5, or the connectors shown by FIGS. 1-4 and FIG. 6).

At 702, the method includes determining whether the engine is operating. Determining whether the engine is operating may be passive and thus is not an action performed by a controller or by the nozzle. Instead, if the engine is in an operating state (e.g., the engine is on, which may include combusting intake air and fuel via engine cylinders), the method automatically continues from 702 to 704, and if the engine is not in an operating state (e.g., the engine is off and is not combusting intake air and fuel), the method automatically continues from 702 to 706. In both cases (e.g., whether the engine is operating or is not operating), the method continues automatically without assistance or measurement from the controller or any sensors electrically coupled to the controller.

If the engine is operating, the method continues at 704 where the method includes directing intake air including at least some exhaust gas from an intake passage, downstream of a compressor, to an outlet of a turbine via a nozzle including a constriction. For example, directing intake air from the intake passage to the outlet of the turbine via the nozzle may include flowing intake air from the intake passage, through a first conduit coupled to the intake passage, upstream of the intake manifold, and an inlet port of the nozzle, through the constriction of the nozzle, through a second conduit coupled to an outlet port of the nozzle and the outlet of the turbine, and to the outlet of the turbine. The exhaust gas from the intake passage may have been cooled by an EGR cooler. In one example, gases may flow through the first conduit, through the constriction of the nozzle, and through the second conduit, but gases may not flow through the second conduit, through the constriction of the nozzle, and through the first conduit. As another example, directing intake air from the intake passage to the outlet of the turbine via the nozzle may include flowing intake air from the inlet port and through the outlet port of the nozzle and not through a drain port of the nozzle coupled to an engine waste sump. In other words, gases may not flow through the first conduit coupled to the inlet port, through the constriction of the nozzle, and into a conduit coupled to the drain port. In one example, the engine waste sump may be a fluid collector such as the fluid collectors described above in the discussion of FIGS. 1-6.

The method continues to 708 where the method includes directing exhaust gas from an exhaust passage to the intake passage, upstream of where the first conduit couples to the intake passage and downstream of the compressor. For example, exhaust gas may flow from the exhaust passage and through the EGR cooler. The EGR cooler may reduce a temperature of the exhaust gas, and the exhaust gas may then flow into the intake passage downstream of the compressor. The exhaust gas flowing into the intake passage may mix and converge with intake air within the intake passage, and a portion of mixed gases (e.g., exhaust gas and intake air) flowing through the intake passage may flow from the intake passage into the first conduit during engine operation.

If the engine is not operating, the method continues from 702 to 706 where the method includes draining liquid fluid (e.g., water, condensate, coolant, or the like) from the intake passage to an engine waste sump (e.g., fluid collector) via a drain port in the nozzle, where the constriction and drain port of the nozzle are each positioned vertically below the intake manifold and turbine and vertically above the engine waste sump with respect to a surface on which the engine sits. As a first example, draining fluid from the intake passage to the engine waste sump via the nozzle may include directing fluid accumulated within a bottom of the intake passage through the first conduit, through the nozzle, through a third conduit coupled to the drain port of the nozzle, and to the engine waste sump. In other words, when the engine is not operating (e.g., gases are not flowing through the conduits or the nozzle due to engine operation), fluid (e.g., liquid water, coolant, etc.) that has accumulated within the intake passage may flow through the first conduit, into the nozzle, and through the third conduit towards the engine waste sump. In some embodiments, accumulated fluid within an exhaust passage or turbine outlet may also flow into the nozzle via the second conduit, and then flow through the third conduit towards the engine waste sump.

As a second example, an entirety of the first conduit and an entirety of the second conduit are arranged vertically above the drain port and an entirety of the third conduit. In this configuration, gravity may force fluid (e.g., liquid water, coolant, etc.) from the bottom of the intake passage into the first conduit. The fluid may then flow through the nozzle, into the third conduit, and into the engine waste sump. As mentioned above, the engine waste sump may be a fluid collector such as the fluid collectors described above in the discussion of FIGS. 1-6.

FIGS. 3-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. Unless otherwise specified, 'vertically above' and 'vertically below' mean above or below, respectively, relative to a support surface of the engine and the vertical axis, and not directly above or directly underneath. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, by flowing gases through the first conduit coupled to the intake system, into the connector, and through the second conduit coupled to the exhaust system as described above during engine operation, the flow of gases through the connector may reduce a likelihood of flowing gases from the connector into the drain conduit and towards the fluid collector. In this way, an amount of exhaust gas released directly into the atmosphere via the drain conduit coupled to the connector may be decreased. Additionally, while the engine is not operating, accumulated liquids in the intake and/or exhaust system may drain through the first and/or second conduits (respectively) into the connector and flow into the fluid collector via the drain conduit. By draining accumulated liquids from the intake system and/or exhaust system via the connector and conduits, degradation of intake system and/or exhaust system components may be reduced (e.g., a risk of oxide formation within intake and/or exhaust passages may be reduced), and engine performance may be increased (e.g., a risk of injection of liquids into engine cylinders may be reduced).

The technical effect of positioning the connector vertically below the intake manifold and the exhaust passage and vertically above the fluid collector with respect to a surface on which an engine sits is allowing accumulated fluid to drain in a closed loop EGR system from the intake system (and/or exhaust system) when the engine is not running. As a result, when the engine is subsequently operating, fluid that may have otherwise accumulated within the intake manifold may not be blown into the engine, thereby increasing combustion stability. Further, this positioning of the connector allows a portion of intake air to flow from the intake passage to the exhaust passage via the nozzle (and not to the fluid collector) while the engine is operating.

In an embodiment, a system for an exhaust gas recirculation (EGR) system includes a connector fluidly coupled to each of an intake system, an exhaust system, and a fluid collector. The connector is positioned vertically below an intake manifold of the intake system and an exhaust passage of the exhaust system and vertically above the fluid collector with respect to a surface on which an engine sits. In one aspect, the connector (either alone or including attached conduits) may be configured to flow gases from the intake system to the exhaust system during engine operation and to flow liquid (such as accumulated fluid which may include condensate and/or leaked coolant from an EGR cooler of the EGR system) from the intake system and/or exhaust system to the fluid collector when the engine is not operating. The flow of gases and liquid in these situations may be facilitated by the connector's positioning vertically below the intake manifold and exhaust passage and vertically above the fluid collector.

In one example of the system, the connector includes a constriction and a drain port, with the drain port positioned at the constriction, and both the constriction and the drain port are positioned vertically below the intake system and exhaust system. In a second example of the system, the intake system includes an EGR mixer pipe disposed downstream of a compressor and upstream of the intake manifold, and an outlet of an EGR passage of the EGR system is directly coupled to the EGR mixer pipe. In one example, a first conduit coupled is directly to and extending between a bottom of one of the EGR mixer pipe and intake manifold and an inlet port of the connector. In a third example of the system, a second conduit is coupled directly to and extending between an outlet port of the connector and an outlet of a turbine disposed in the exhaust passage. In one example, an entirety of the second conduit is positioned vertically above a drain port of the connector, and the drain port is arranged at a bottom of the connector and fluidly coupled to the fluid collector. In a fourth example of the system, a third conduit is coupled directly to a drain port of the connector and extending between the drain port and the fluid collector. In one example, the drain port is positioned vertically below an inlet port of the connector fluidly coupled to the intake system and an outlet port of the connector fluidly coupled to the exhaust system. In a fifth example of the system, a clamp couples an exterior of the third conduit to an exterior of an EGR cooler of the EGR system and a support bracket mounts an outer housing of the connector directly to a front end cover of the engine.

As another embodiment, a method for an engine includes directing intake air including at least some exhaust gas from an intake passage, downstream of a compressor, to an outlet of a turbine via a nozzle including a constriction during engine operation, and when the engine is not operating, draining fluid from the intake passage to an engine waste sump via a drain port in the nozzle, where the constriction and drain port of the nozzle are each positioned vertically below an intake manifold and turbine and vertically above the engine waste sump with respect to a surface on which the engine sits. In a first example of the method, directing intake air from the intake passage to the outlet of the turbine via the nozzle includes flowing intake air from the intake passage, through a first conduit coupled to the intake passage, upstream of the intake manifold, and an inlet port of the nozzle, through the constriction of the nozzle, through a second conduit coupled to an outlet port of the nozzle and the outlet of the turbine, and to the outlet of the turbine. In one example, during engine operation, exhaust gas may be directed from an exhaust passage to the intake passage, upstream of where the first conduit couples to the intake passage and downstream of the compressor. In another example, directing intake air from the intake passage to the outlet of the turbine via the nozzle includes flowing intake air from the inlet port and through the outlet port of the nozzle and not through the drain port of the nozzle coupled to the engine waste sump. In yet another example, draining fluid from the intake passage to the engine waste sump via the nozzle includes directing fluid accumulated within a bottom of the intake passage through the first conduit, through the nozzle, through a third conduit coupled to the drain port of the nozzle, and to the engine waste sump. In yet another example, an entirety of the first conduit and an entirety of the second conduit are arranged vertically above the drain port and an entirety of the third conduit.

As yet another embodiment, a system for an engine includes an intake passage including a compressor driven by a turbine, with the compressor positioned upstream of an intake manifold; an exhaust gas recirculation (EGR) system including an EGR passage coupled to the intake passage downstream of the compressor and upstream of the intake manifold; an engine waste sump positioned vertically below the intake manifold with respect to a surface on which the engine sits; a venturi nozzle having a first end fluidly coupled to the intake passage, downstream of where the EGR passage couples to the intake passage and upstream of the intake manifold, a second end fluidly coupled to an outlet of the turbine, and a vacuum, third end fluidly coupled to the engine waste sump, where the venturi nozzle is positioned vertically below the intake passage and turbine and vertically above the engine waste sump. In a first example of the system, the system includes a first conduit with a first end coupled to a low point of the intake passage, downstream of where the EGR passage couples to the intake passage and upstream of the intake manifold, and a second end coupled to the first end of the venturi nozzle. In a second example, the system includes a second conduit with a first end coupled to the second end of the venturi nozzle and a second end coupled to the outlet of the turbine. In a third example, the system includes a third conduit with a first end coupled to the vacuum, third end of the nozzle and a second end positioned above the engine waste sump. In a fourth example, the EGR system includes an EGR cooler disposed upstream of where the EGR passage couples to the intake passage.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for an exhaust gas recirculation (EGR) system, comprising:

a connector fluidly coupled to each of an intake system, an exhaust system, and a fluid collector, where the connector is positioned vertically below an intake manifold of the intake system and an exhaust passage of the exhaust system and vertically above the fluid collector with respect to a surface on which an engine sits, wherein the connector is configured to flow gases from the intake system through the connector and to the exhaust system during engine operation, and to flow non-gaseous fluid from the intake system through the connector and into the fluid collector.

2. The system of claim 1, wherein the connector includes a constriction and a drain port, the drain port positioned at the constriction, and wherein both the constriction and the drain port are positioned vertically below the intake system and exhaust system.

3. The system of claim 1, wherein the intake system includes an EGR mixer pipe disposed downstream of a compressor and upstream of the intake manifold, where an outlet of an EGR passage of the EGR system is directly coupled to the EGR mixer pipe.

4. The system of claim 3, further comprising a first conduit coupled directly to and extending between an inlet port of the connector and a bottom of one of the EGR mixer pipe and intake manifold.

5. The system of claim 1, further comprising a second conduit coupled directly to and extending between an outlet port of the connector and an outlet of a turbine disposed in the exhaust passage.

6. The system of claim 5, wherein an entirety of the second conduit is positioned vertically above a drain port of the connector, the drain port arranged at a bottom of the connector and fluidly coupled to the fluid collector.

7. The system of claim 1, further comprising a third conduit coupled directly to a drain port of the connector and extending between the drain port and the fluid collector.

8. The system of claim 7, wherein the drain port is positioned vertically below an inlet port of the connector fluidly coupled to the intake system and an outlet port of the connector fluidly coupled to the exhaust system.

9. The system of claim 7, further comprising a clamp coupling an exterior of the third conduit to an exterior of an EGR cooler of the EGR system and further comprising a support bracket mounting an outer housing of the connector directly to a front end cover of the engine.

10. A method for an engine, comprising:

during engine operation, directing intake air including at least some exhaust gas from an intake passage, downstream of a compressor, to an outlet of a turbine via a nozzle including a constriction; and when the engine is not operating, draining fluid from the intake passage to an engine waste sump via a drain port in the nozzle, where the constriction and drain port of the nozzle are each positioned vertically below an intake manifold and turbine and vertically above the engine waste sump with respect to a surface on which the engine sits.

11. The method of claim 10, wherein directing intake air from the intake passage to the outlet of the turbine via the nozzle includes flowing intake air from the intake passage, through a first conduit coupled to the intake passage, upstream of the intake manifold, and an inlet port of the nozzle, through the constriction of the nozzle, through a second conduit coupled to an outlet port of the nozzle and the outlet of the turbine, and to the outlet of the turbine.

12. The method of claim 11, further comprising, during engine operation, directing exhaust gas from an exhaust passage to the intake passage, upstream of where the first conduit couples to the intake passage and downstream of the compressor.

13. The method of claim 11, wherein directing intake air from the intake passage to the outlet of the turbine via the nozzle includes flowing intake air from the inlet port and through the outlet port of the nozzle and not through the drain port of the nozzle coupled to the engine waste sump.

14. The method of claim 11, wherein draining fluid from the intake passage to the engine waste sump via the nozzle includes directing fluid accumulated within a bottom of the intake passage through the first conduit, through the nozzle, through a third conduit coupled to the drain port of the nozzle, and to the engine waste sump.

15. The method of claim 14, wherein an entirety of the first conduit and an entirety of the second conduit are arranged vertically above the drain port and an entirety of the third conduit.

16. A system for an engine, comprising:

an intake passage including a compressor driven by a turbine, where the compressor is positioned upstream of an intake manifold;

an exhaust gas recirculation (EGR) system including an EGR passage coupled to the intake passage downstream of the compressor and upstream of the intake manifold;

an engine waste sump positioned vertically below the intake manifold with respect to a surface on which the engine sits; and a venturi nozzle having a first end fluidly coupled to the intake passage, downstream of where the EGR passage couples to the intake passage and upstream of the intake manifold, a second end fluidly coupled to an outlet of the turbine, and a vacuum, third end fluidly coupled to the engine waste sump, where the venturi nozzle is positioned vertically below the intake passage and turbine and vertically above the engine waste sump.

17. The system of claim 16, further comprising a first conduit with a first end coupled to a low point of the intake passage, downstream of where the EGR passage couples to the intake passage and upstream of the intake manifold, and a second end coupled to the first end of the venturi nozzle.

18. The system of claim 16, further comprising a second conduit with a first end coupled to the second end of the venturi nozzle and a second end coupled to the outlet of the turbine.

19. The system of claim 16, further comprising a third conduit with a first end coupled to the vacuum, third end of the nozzle and a second end positioned above the engine waste sump.

20. The system of claim 16, wherein the EGR system includes an EGR cooler disposed upstream of where the EGR passage couples to the intake passage.

21. The system of claim 1, wherein the connector comprises a venturi nozzle.

22. The system of claim 21, wherein the venturi nozzle has a first end with an inlet port coupled to the intake system, a second end with an outlet port coupled to the exhaust system, and a drain port coupled to the fluid collector, the venturi nozzle defining a first inner passage, a second inner passage, and a third inner passage, the first and second inner passages being contiguous along an axis of the venturi nozzle and extending from the inlet port to the outlet port, and the third inner passage being fluidly coupled to and extending down from the second inner passage to the drain port, wherein the first inner passage has a larger diameter than a diameter of the second inner passage to define a constriction for increasing a velocity of the gases flowing from the intake system through the connector, from the inlet port to the outlet port, and to the exhaust system.

* * * * *